US005984208A

United States Patent [19]

Martin et al.

[11] Patent Number: 5,984,208

[45] Date of Patent: Nov. 16, 1999

[54] FUEL INJECTOR HAVING A PRESS-IN VALVE SEAT

[75] Inventors: David E. Martin, Normal; James J. Streicher, Pontiac; Clifford J. Rebello; Prabhakar Ramalingam, both of Normal, all of Ill.

[73] Assignees: Caterpillar Inc., Peoria, Ill.; Lucas Industries Public Limited Company, Solihull, United Kingdom

[21] Appl. No.: 08/963,426

[22] Filed: Nov. 3, 1997

[51] Int. Cl.[6] ..... F02M 61/00

[52] U.S. Cl. ..... 239/533.2

[58] Field of Search ..... 239/88–91, 96, 239/533.2, 533.3, 533.8, 533.9, 533.12

[56] References Cited

U.S. PATENT DOCUMENTS

| | | | |
|---|---|---|---|
| 1,732,241 | 10/1929 | Murray, Jr. | 29/157.1 |
| 2,419,243 | 4/1947 | Allen et al. | 29/157.1 |
| 3,511,442 | 5/1970 | De Luca et al. | 239/533 |
| 3,593,400 | 7/1971 | Geiselman et al. | 29/157.1 R |
| 3,729,025 | 4/1973 | Silvestrini | 137/625.33 |
| 4,079,491 | 3/1978 | Richardson | 29/157.1 R |
| 4,120,456 | 10/1978 | Kimura et al. | 239/464 |
| 4,266,727 | 5/1981 | Happel et al. | 239/409 |
| 4,298,088 | 11/1981 | Keller | 181/211 |
| 4,375,274 | 3/1983 | Thoma et al. | 239/117 |
| 4,392,612 | 7/1983 | Deckard et al. | 239/88 |
| 4,467,510 | 8/1984 | Kinoshita et al. | 29/157.1 R |
| 4,521,948 | 6/1985 | Laue | 29/157.1 R |
| 4,658,824 | 4/1987 | Scheibe | 123/472 |
| 4,714,199 | 12/1987 | Heath et al. | 239/412 |
| 4,735,224 | 4/1988 | Pluviose | 137/1 |
| 5,018,273 | 5/1991 | Lambertus | 29/890.142 |
| 5,127,156 | 7/1992 | Yokoyama et al. | 29/890.143 |
| 5,192,026 | 3/1993 | Rix et al. | 239/533.3 |
| 5,207,385 | 5/1993 | Turner | 239/533.3 |
| 5,292,072 | 3/1994 | Rix et al. | 239/533.3 |
| 5,626,295 | 5/1997 | Heyse et al. | 239/596 |

FOREIGN PATENT DOCUMENTS

| | | |
|---|---|---|
| 0 425 236 A1 | 5/1991 | European Pat. Off. . |
| 0 449 662 A1 | 10/1991 | European Pat. Off. . |
| 635994 | 3/1962 | Italy . |
| 981664 | 12/1982 | U.S.S.R. . |
| 1298876 | 12/1972 | United Kingdom . |
| 1 472 125 | 5/1977 | United Kingdom . |
| 2152135 | 7/1985 | United Kingdom . |

*Primary Examiner*—Lesley D. Morris
*Attorney, Agent, or Firm*—Marshall, O'Toole, Gerstein, Murray & Borun

[57] ABSTRACT

A fuel injector includes a barrel having an insert recess therein within which an insert is disposed. A facing surface of the insert is located opposite a base surface of the recess and forms a passage interconnecting a high pressure fuel passage and a valve bore. High pressure intersecting bores are thus avoided, leading to a reduction in structural failures.

22 Claims, 3 Drawing Sheets

FUEL INJECTOR HAVING A PRESS-IN VALVE SEAT

TECHNICAL FIELD

The present invention generally relates to fuel injectors, and more particularly to a fuel injector having a passage which conducts high pressure fluid.

BACKGROUND ART

Fuel injectors are today used in many engines, for example in diesel engines used in trucks and off-highway equipment. The recent efforts to reduce engine emissions have focused on, among other things, a more complete combustion of the air-fuel mixture in the engine cylinders. This, in turn, is facilitated by pressurizing the fuel in the fuel injectors to a very high level, for example 207 MPa (30,000 p.s.i). Because of the high pressures, passages in the fuel injector must be carefully designed so that structural failures are avoided. Intersecting passages pose a particular problem owing to the possibility of hoop stresses in the passages being additive, thereby further increasing the possibility of fatigue cracking.

One type of fuel injector utilizes a valving mechanism comprising a high-pressure spill valve and a direct operated check (DOC) valve wherein the former is operated to circulate fuel through the injector for cooling, to control injection pressure and to reduce the back pressure exerted by the injector plunger on the camshaft following injection.

SUMMARY OF THE INVENTION

A fuel injector includes an insert which creates an intersecting passage that eliminates additive hoop stresses and which further forms a seat for a spill valve.

More particularly, in accordance with one aspect of the present invention, a fuel injector includes a member having a first passage terminating at a base surface of a recess. A body is disposed in the recess and has a facing surface opposite the base surface and spaced therefrom to form a second passage placing the high pressure passage in fluid communication with a third passage.

Preferably, the body includes a fourth passage in fluid communication with the first passage via the second passage.

Further, the third passage may comprise a valve bore in the body. Also preferably, a guide bore is located in the member aligned with the valve bore and is placed in fluid communication with the first passage by the second passage. Still further, the first passage may be disposed at a certain radial distance from a central axis of the valve bore and the facing surface may have a central axis substantially coincident with the central axis of the valve bore and also may have a radial extent greater than the certain radial distance.

In addition, the body preferably has a radius greater than the radius of the facing surface. Also preferably, the member comprises a barrel, the body comprises an insert having a valve seat and a spill valve engageable with the valve seat is disposed in the third passage.

Also the third passage and the insert may be circular in elevation and the third passage may be centrally located in the insert.

Still further, the facing surface preferably has a first radial extent and further including a fourth passage in the body disposed at a second radius less than the first radial extent.

In accordance with another aspect of the present invention, a fuel injector includes a barrel having an insert recess and a first passage having an end in fluid communication with the insert recess and an insert is disposed in the insert recess and having a second passage in fluid communication with the first passage, a valve bore in fluid communication with the second passage and a surface defining a valve seat. A valve member is disposed in the valve bore and has a sealing surface and is movable to a position wherein the sealing surface is in sealing engagement with the valve seat.

In accordance with another aspect of the present invention, a fuel injector includes a barrel having an insert recess defined by a base surface, a first passage having an end in fluid communication with the insert recess and a guide bore spaced from the first passage. An insert is disposed in the insert recess and forms a second passage with the base surface. The insert includes a valve bore in fluid communication with the first passage via the second passage and a surface defining a valve seat wherein the guide bore is concentric with and in fluid communication with the valve bore. A valve member is disposed in the valve bore and has a sealing surface and is movable between an open position at which the sealing surface is spaced from the valve seat and a closed position wherein the sealing surface is in sealing engagement with the valve seat.

Other features and advantages of the present invention will be apparent to those skilled in the art from the following detailed description taken in conjunction with the drawings and the appended claims.

DESCRIPTION OF THE PREFERRED EMBODIMENTS

Figure 1:
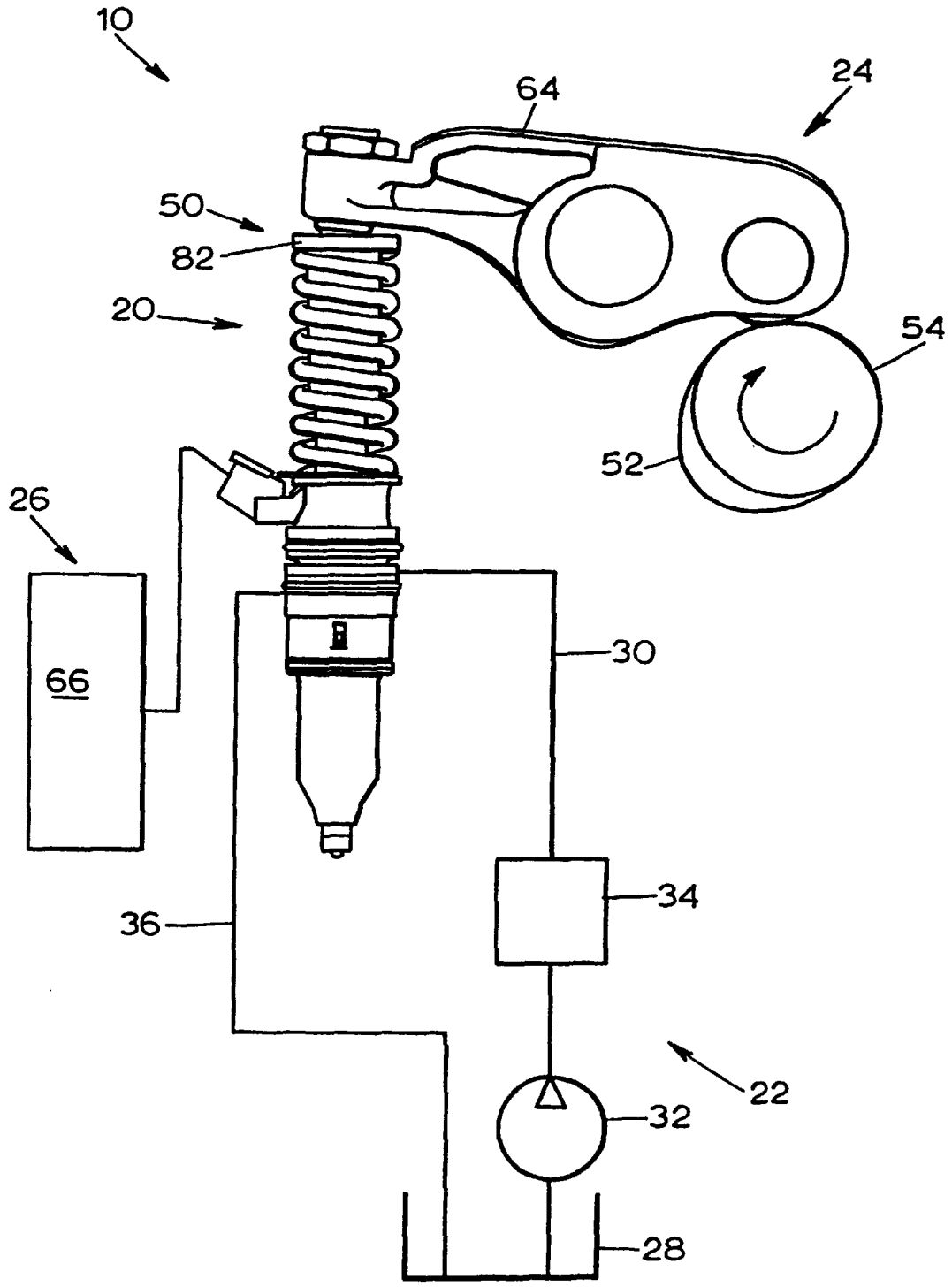
FIG. 1 is an elevational view of a fuel injector incorporating the present invention together with a camshaft and rocker arm and further illustrating a block diagram of a transfer pump and a drive circuit for controlling the fuel injector.

Referring to FIG. 1, a portion of a fuel system 10 is shown adapted for a direct-injection diesel-cycle reciprocating internal combustion engine. However, it should be understood that the present invention is also applicable to other types of engines, such as rotary engines or modified-cycle engines, and that the engine may contain one or more engine combustion chambers or cylinders. The engine has at least one cylinder head wherein each cylinder head defines one or more separate injector bores, each of which receives an injector 20 according to the present invention.

The fuel system 10 further includes apparatus 22 for supplying fuel to each injector 20, apparatus 24 for causing each injector 20 to pressurize fuel and apparatus 26 for electronically controlling each injector 20.

The fuel supplying apparatus 22 preferably includes a fuel tank 28, a fuel supply passage 30 arranged in fluid communication between the fuel tank and the injector 20, a relatively low pressure fuel transfer pump 32, one or more fuel filters 34 and a fuel drain passage 36 arranged in fluid communication between the injector 20 and the fuel tank 28. If desired, fuel passages may be disposed in the head of the engine in fluid communication with the fuel injector 20 and one or both of the passages 30 and 36.

The apparatus 24 may be any mechanically actuated device or hydraulically actuated device. In the embodiment shown a tappet and plunger assembly 50 associated with the injector 20 is mechanically actuated indirectly or directly by a cam lobe 52 of an engine-driven cam shaft 54. In the embodiment shown, the cam lobe 52 drives a pivoting rocker arm assembly 64 which in turn reciprocates the tappet and plunger assembly 50. Alternatively, a push rod (not shown) may be positioned between the cam lobe 52 and the rocker arm assembly 64.

The electronic controlling apparatus 26 preferably includes an electronic control module (ECM) 66 which controls: (1) fuel injection timing; (2) total fuel injection quantity during an injection cycle; (3) fuel injection pressure; (4) the number of separate injection segments during each injection cycle; (5) the time interval(s) between the injection segments; and (6) the fuel quantity delivered during each injection segment of each injection cycle.

Preferably, each injector 20 is a unit injector which includes in a single housing apparatus for both pressurizing fuel to a high level (for example, 207 MPa (30,000 p.s.i.)) and injecting the pressurized fuel into an associated cylinder. Although shown as a unitized injector 20, the injector could alternatively be of a modular construction wherein the fuel injection apparatus is separate from the fuel pressurization apparatus.

Figure 2:
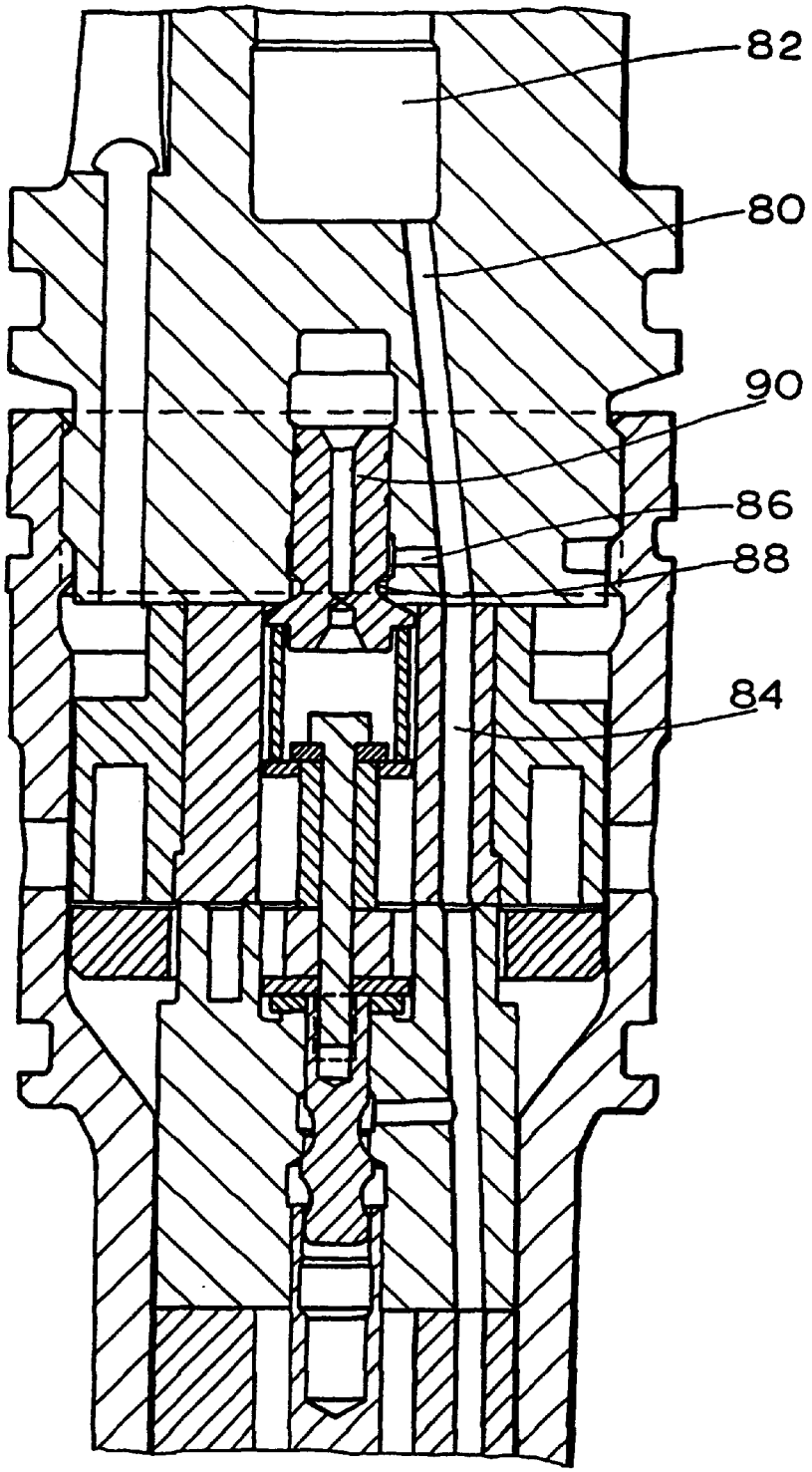
FIG. 2 is a sectional view of the fuel injector of FIG. 1.

Referring now to FIG. 2, each injector 20 includes a high pressure fuel passage 80 leading from a plunger bore 82 to a passage 84. A cross passage 86 places the fuel passage 80 in fluid communication with a spill valve bore 88 within which is disposed a spill valve poppet 90. During operation of the injector 20, high pressure fuel is delivered to the spill valve bore 88 through the cross passage 86. The fluid pressure exerts a force on the walls of the cross passage 86 and the spill valve bore 88 that tends to radially expand or stretch those walls producing a hoop stress therein. This effect is particularly pronounced at or near the intersection of the cross passage 86 with the spill valve bore 88, where tensile stresses are developed at magnitudes that can lead to structural fatigue and failure.

Industrial Applicability

Figure 3:
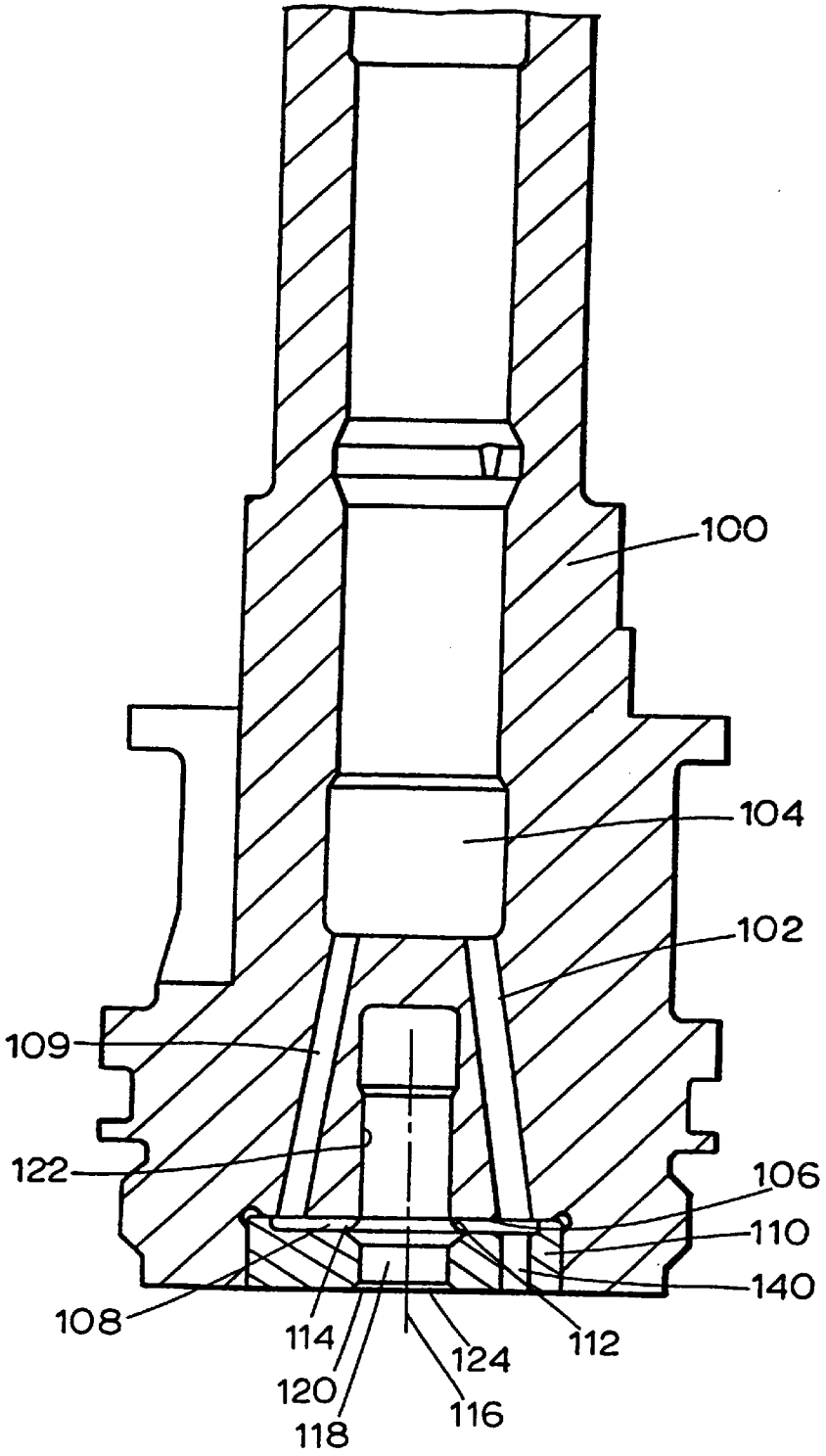
FIG. 3 is an enlarged, fragmentary sectional view of modifications to the fuel injector of FIG. 2 to incorporate the present invention.

FIG. 3 illustrates modifications to the fuel injector 20 to incorporate the present invention. A member in the form of a barrel 100 includes a first or high pressure fuel passage 102 leading from a plunger recess 104 and terminating at a base surface 106 of an insert recess 108 wherein the insert is circular in elevation (i.e., in plan view in the orientation shown in FIG. 3). A further high pressure fuel passage 109 may also lead from the plunger recess 104 to the insert recess 108. A body or insert 110 of complementary shape to the recess 108 and having an outer radius slightly greater than the radius of the recess 108 is press-fitted to form an interference fit with the walls defining the recess 108 or is otherwise secured therein. The insert 110 includes a facing surface 112 opposite the base surface 106 and spaced therefrom to form a passage 114 which is preferably slot-shaped or any other suitable shape in elevation and having a radial extent centered on a central axis 116. Also preferably, the first passage is disposed at a certain radial distance from the central axis 116 wherein the radial extent of the facing surface 112 is greater than the certain radial distance.

A passage comprising a valve bore 118 is formed in the insert 110 coincident with the central axis 116. The insert further includes a wall 120 defining a valve seat 124. A guide bore 122 coincident with and similarly sized to the valve bore 118 is formed in the barrel 100. The valve bore 118 and the guide bore 122 are circular in elevation and a valve member in the form of the spill valve poppet 90 is disposed in the valve bore 118 and extends into the guide bore 122. The spill valve poppet 90 is movable between an open position at which the poppet 90 is spaced from the valve seat 124 and a closed position at which the poppet 90 is in sealing contact with the valve seat 124.

A further passage 140 is formed in the insert 110 and is disposed at a radial distance less than the radial extent of the facing surface 112. This radial distance may be the same as or different than the radial distance of the passage 102 from the central axis 116. Still further, the passage 140 may be aligned with the passage 102 or the passage 109 or may be angularly offset with respect thereto if the facing surface is other than slot-shaped in elevation.

Preferably, the bore 118, the valve guide bore 122 and the valve seat surfaces 124 are produced by a grinding operation after the insert 110 is placed in the recess 108.

The barrel 100 is then assembled with other components of the fuel injector 20.

As should be evident from an inspection of FIG. 3, the passage 114 interconnects the high pressure fuel passages 102 and 140, and the bores 118 and 122, thereby obviating the need for a conventional drilled passage to accomplish this result. The passage 114 does not experience the stress levels encountered by conventional intersecting passages, and hence the incidence of structural failure is minimized.

Numerous modifications and alternative embodiments of the present invention will be apparent to those skilled in the art in view of the foregoing description. Accordingly, this description is to be construed as illustrative only and is for the purpose teaching those skilled in the art the best mode of carrying out the invention. The details of the structure and/or function may be varied substantially without departing from the spirit of the invention, and the exclusive use of all modifications which come within the scope of the appended claims is reserved.

We claim:

1. A fuel injector, comprising:

a barrel having a first passage terminating at a base surface of a recess;

an insert disposed in the recess and having a valve seat and a facing surface opposite the base surface and spaced therefrom to form a second passage placing the first passage in fluid communication with a third passage; and a spill valve engageable with the valve seat and disposed in the third passage.

2. The fuel injector of claim 1, wherein the body includes a fourth passage in fluid communication with the first passage via the second passage.

3. The fuel injector of claim 1, wherein the third passage comprises a valve bore in the body.

4. The fuel injector of claim 3, further including a guide bore in the member aligned with the valve bore and placed in fluid communication with the first passage by the second passage.

5. The fuel injector of claim 4, wherein the first passage is disposed at a certain radial distance from a central axis of the valve bore and wherein the facing surface has a central axis substantially coincident with the central axis of the valve bore and further has a radial extent greater than the certain radial distance.

6. The fuel injector of claim 5, wherein the body forms an interference fit with walls defining the recess.

7. The fuel injector of claim 1, wherein the third passage and the insert are circular in elevation.

8. The fuel injector of claim 7, wherein the third passage is centrally located in the insert.

9. The fuel injector of claim 8, wherein the facing surface has a first radial extent and further including a fourth passage in the body disposed at a second radius less than the first radial extent.

10. A fuel injector, comprising:

a barrel having an insert recess and a first passage having an end in fluid communication with the insert recess;

an insert disposed in the insert recess and having a second passage in fluid communication with the first passage, a valve bore in fluid communication with the second passage and a surface defining a valve seat; and a valve member disposed in the valve bore and having a sealing surface and movable to a position wherein the sealing surface is in sealing engagement with the valve seat.

11. The fuel injector of claim 10, wherein the barrel further includes a guide bore spaced from the first passage and disposed in fluid communication with the second passage and the valve bore.

12. The fuel injector of claim 11, wherein the guide bore is concentric with the valve bore.

13. The fuel injector of claim 10, wherein the valve bore and the insert are circular in elevation.

14. The fuel injector of claim 13, wherein the valve bore is centrally located in the insert.

15. The fuel injector of claim 10, wherein the first passage is disposed at a certain radial distance from a central axis of the valve bore and wherein the second passage has a central axis substantially coincident with the central axis of the valve bore and further has a radial extent greater than the certain radial distance.

16. The fuel injector of claim 15, further including an additional passage in the insert in fluid communication with the first passage.

17. A fuel injector, comprising:

a barrel having an insert recess defined by a base surface, a first passage having an end in fluid communication with the insert recess and a guide bore spaced from the first passage;

an insert disposed in the insert recess and forming a second passage with the base surface, the insert having a valve bore in fluid communication with the first passage via the second passage and a surface defining a valve seat wherein the guide bore is concentric with and in fluid communication with the valve bore; and a valve member disposed in the valve bore and having a sealing surface and movable between an open position at which the sealing surface is spaced from the valve seat and a closed position wherein the sealing surface is in sealing engagement with the valve seat.

18. The fuel injector of claim 17, wherein the insert recess and the insert are circular in elevation.

19. The fuel injector of claim 18, wherein the valve bore is centrally located in the insert.

20. The fuel injector of claim 19, wherein the first passage is disposed at a certain radial distance from a central axis of the valve bore and wherein the insert has a central axis substantially coincident with the central axis of the valve bore and further is circular in elevation and has a radius greater than the certain radial distance.

21. The fuel injector of claim 20, wherein the valve bore and the guide bore are substantially coincident with a central axis of the insert.

22. The fuel injector of claim 20 wherein the insert includes a further passage disposed at a further certain radial distance from the central axis of the valve bore.

* * * * *

UNITED STATES PATENT AND TRADEMARK OFFICE

CERTIFICATE OF CORRECTION

PATENT NO. : 5,984,208
DATED : November 16, 1999
INVENTOR(S) : Martin et al.

It is certified that error appears in the above-identified patent and that said Letters Patent is hereby corrected as shown below:

Column 2,
Lines 32-33, delete "incorporating the present invention".

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*